US011987460B2

(12) United States Patent
Goodell

(10) Patent No.: US 11,987,460 B2
(45) Date of Patent: May 21, 2024

(54) REEL SUPPORT DEVICE

(71) Applicant: Kwik Lok Corporation, Yakima, WA (US)

(72) Inventor: Bruce Goodell, Yakima, WA (US)

(73) Assignee: Kwik Lok Corporation, Yakima, WA (US)

( * ) Notice: Subject to any disclaimer, the term of this patent is extended or adjusted under 35 U.S.C. 154(b) by 320 days.

(21) Appl. No.: 17/339,057

(22) Filed: Jun. 4, 2021

(65) Prior Publication Data

US 2022/0009737 A1 Jan. 13, 2022

Related U.S. Application Data

(60) Provisional application No. 63/050,949, filed on Jul. 13, 2020.

(51) Int. Cl.
*B65H 16/02* (2006.01)

(52) U.S. Cl.
CPC ..... *B65H 16/024* (2020.08); *B65H 2402/352* (2013.01); *B65H 2402/60* (2013.01); *B65H 2408/24156* (2013.01); *B65H 2701/192* (2013.01)

(58) Field of Classification Search
USPC ..... 242/611; 248/176.1, 177.1, 415, 418
See application file for complete search history.

(56) References Cited

U.S. PATENT DOCUMENTS 2,563,398 A * 8/1951 Courtney ..... D01H 7/042 242/597.6
3,165,277 A * 1/1965 Nordlof ..... B65H 49/34 242/413.4
3,366,343 A * 1/1968 Messamer ..... G11B 15/662
3,495,784 A * 2/1970 Bradlee ..... B21C 47/003 242/420.6
3,893,636 A * 7/1975 Wise ..... B65H 23/185 242/597
3,960,337 A * 6/1976 Schroeder ..... G03B 21/321 242/597.3

(Continued)

OTHER PUBLICATIONS

Kwik Lok®, "865 Automatic Bag Closing Machine," Oct. 12, 2017, available at URL=https://www.kwiklok.com/brochures/, 2 pages.

(Continued)

*Primary Examiner* — William A. Rivera
(74) *Attorney, Agent, or Firm* — Seed IP Law Group LLP

(57) ABSTRACT

A reel assembly includes a plurality of reels coupled to a reel support device. The reels are configured to rotate relative to the reel support device to dispense materials. The reel support device includes a first plate coupled to a second plate with fasteners that are coupled to first holes in the first plate and include a fastening portion received in second holes in the second plate. The fasteners are removably coupled to the second holes, such that an operator can rotate the first plate relative to the second plate by applying a lateral force to the first plate to remove the fastening portion from the second holes. The first plate rotates until the fastening portion is secured in a successive one of the second holes. During normal operation, an elastic element in the fasteners holds the first plate in position until the force is provided by the operator.

13 Claims, 4 Drawing Sheets

(56) References Cited

U.S. PATENT DOCUMENTS

| | | | | |
|---|---|---|---|---|
| 4,005,563 | A * | 2/1977 | Nitsch | B65B 51/08 53/138.8 |
| 4,077,187 | A * | 3/1978 | Paxton | B41F 19/068 53/131.5 |
| 4,824,250 | A * | 4/1989 | Newman | G01N 21/88 73/657 |
| 8,261,513 | B2 * | 9/2012 | Irwin | B65B 51/043 53/76 |
| 8,474,227 | B2 * | 7/2013 | Irwin | B65B 51/08 53/414 |
| 10,926,969 | B1 * | 2/2021 | Shea | B65H 19/2292 |
| 2004/0206847 | A1 * | 10/2004 | Schanke | B65H 18/08 242/423.1 |
| 2006/0151659 | A1 * | 7/2006 | Anderson | B65H 23/195 242/545.1 |
| 2014/0252155 | A1 * | 9/2014 | Vantrease | B65H 19/1868 242/555 |
| 2018/0029825 | A1 * | 2/2018 | Temblador | B65H 75/2245 |

OTHER PUBLICATIONS

McMaster-Carr, "Steel Metric Ball-Nose Spring Plunger, M12x1.75 Thread, 16.8-25.7 lb. Nose Force," URL=https://www.mcmaster.com/3391a44-3391A64, Download Date Apr. 27, 2020, 2 pages.

* cited by examiner

REEL SUPPORT DEVICE

BACKGROUND

Technical Field

The present disclosure relates to product packaging, and more specifically, to a device for supporting multiple reels of material to be applied to a package.

Description of the Related Art

Closures, ties, labels and other materials are known for use in product packaging. In some cases, these materials are applied to product packages manually, while in some cases, machines automatically apply these materials to the product packaging. In applications that utilize a machine, the materials are often stored on large reels and fed into a machine for applying the materials to the packaging. The reels are connected to a mount and configured to rotate relative to the mount to pay out the materials as they are applied to the product by the machine. To facilitate additional capacity, mounts have been developed to support two reels.

For example, production using a known system begins with both reels full of material. When a first reel is empty, the operator manipulates a spring plunger and rotates the mount to bring the second, full reel into position for application of material from the second reel. Then, the first, empty reel is replaced with another full reel, and the process continues. However, two reels are often not sufficient in instances where different materials are changed periodically depending on the product ran through the machine (e.g., a closure or a closure with a label) is to be applied, because one of the reels will run out of material while the second reel holds the alternate material, such that production must be stopped to replace the empty the reel. Moreover, known mounts for supporting the reels utilize spring plungers that are difficult to manipulate or hard to reach, such that it is difficult to switch between reels. Further, production must be paused and the operator must reach up and pull the plunger and rotate the device in order to move a new reel into position for application, which decreases efficiency.

BRIEF SUMMARY

The present disclosure describes a device for supporting at least three reels of material. The reels of material may contain bag closures, ties, labels, or other product packaging materials. The device includes a top plate and a bottom plate that are coupled together such that the top plate can rotate relative to the bottom plate. The reels are coupled to flanges extending from the top plate. The top plate also includes a first number of holes through the top plate. The bottom plate includes a second number of holes that are aligned with the first number of holes. In some examples, each of the second number of holes in the bottom plate include a chamfered upper edge. The device further includes fasteners with a fastening portion containing threads, similar to a standard screw, as well as a securing portion, which includes a ball. The fasteners are inserted through the first holes in the top plate, with the fastening portion secured to corresponding threads in the first holes. The securing portion, or ball, of each of the fasteners is received in the second holes in the bottom plate. The balls are supported by springs internal to the fasteners, such that the balls are driven down into the second holes by the springs and in contact with the chamfered edges.

As such, in operation, the reels rotate to dispense materials. When a reel is empty or when the operator wishes to change the material being applied (e.g., from a closure to a label), the operator provides a lateral force to the reel and device assembly, which displaces the balls from the second number of holes in the bottom plate, aided in some cases by the chamfered edges of the second holes. Once the balls are free from the second holes, the operator can rotate the top plate relative to the bottom plate until a full reel is in position to dispense materials. When the new, full reel is in position, the balls will again be secured in the second number of holes, such that the new reel is aligned to dispense material while the top plate is temporarily locked in position via the balls and the springs in the fasteners.

As such, one or more embodiments of a system according to the present disclosure may be summarized as including: a vertical mast; a support coupled to the vertical mast and extending perpendicular from the mast; a payoff reel coupled to the support and configured to rotate about a first axis defined by the support; and a reel support device coupled to the mast and configured to rotate relative to the mast about a second axis defined by the mast and about a third axis perpendicular to the second axis, the reel support device including a first plate including a plurality of flanges and a vertical bore extending into a center of the first plate, the first plate further including a plurality of cavities spaced equidistant from each other about the bore with each cavity proximate a corresponding one of the plurality of flanges, a plurality of first holes through the first plate and spaced equidistant from each other about the bore, each of the plurality of first holes located between corresponding ones of the plurality of flanges, a second plate coupled to the first plate, the second plate having a protrusion extending from a center of the second plate with a size and a shape to be received in the bore of the first plate, and a plurality of second holes through the second plate and spaced equidistant from each other about the protrusion, the second plate including a chamfered edge around each of the plurality of second holes.

The system may further include: a plurality of fasteners, each of the plurality of fasteners including a fastening portion and a securing portion, the fastening portion extending through a corresponding one of the plurality of first holes and including first threads configured to engage corresponding second threads in the plurality of first holes and the securing portion including a ball removably received in a corresponding one of the plurality of second holes and in contact with at least a portion of the chamfered edge around each of the plurality of second holes, wherein each of the plurality of fasteners further includes an internal spring in contact with the ball, wherein the spring is configured to seat the ball in the corresponding one of the plurality of second holes and wherein a manual force is applied to the first plate to unseat the ball from the corresponding one of the plurality of second holes to allow for rotation of the first plate relative to the second plate; and a plurality of reels coupled to the reel support device, each of the plurality of reels including a plurality of closures or a plurality of labels wound around each of the plurality of reels, wherein a first one of the plurality of reels is aligned with the payoff reel.

BRIEF DESCRIPTION OF THE SEVERAL VIEWS OF THE DRAWINGS

For a better understanding of the embodiments, reference will now be made by way of example only to the accompanying drawings. In the drawings, identical reference numbers identify similar elements or acts. In some drawings, the sizes and relative positions of elements are not necessarily drawn to scale. For example, the shapes of various elements and angles are not necessarily drawn to scale, and some of these elements may be enlarged and positioned to improve drawing legibility. In other drawings, the size and relative position of elements are exactly to scale.

DETAILED DESCRIPTION

Figure 1:
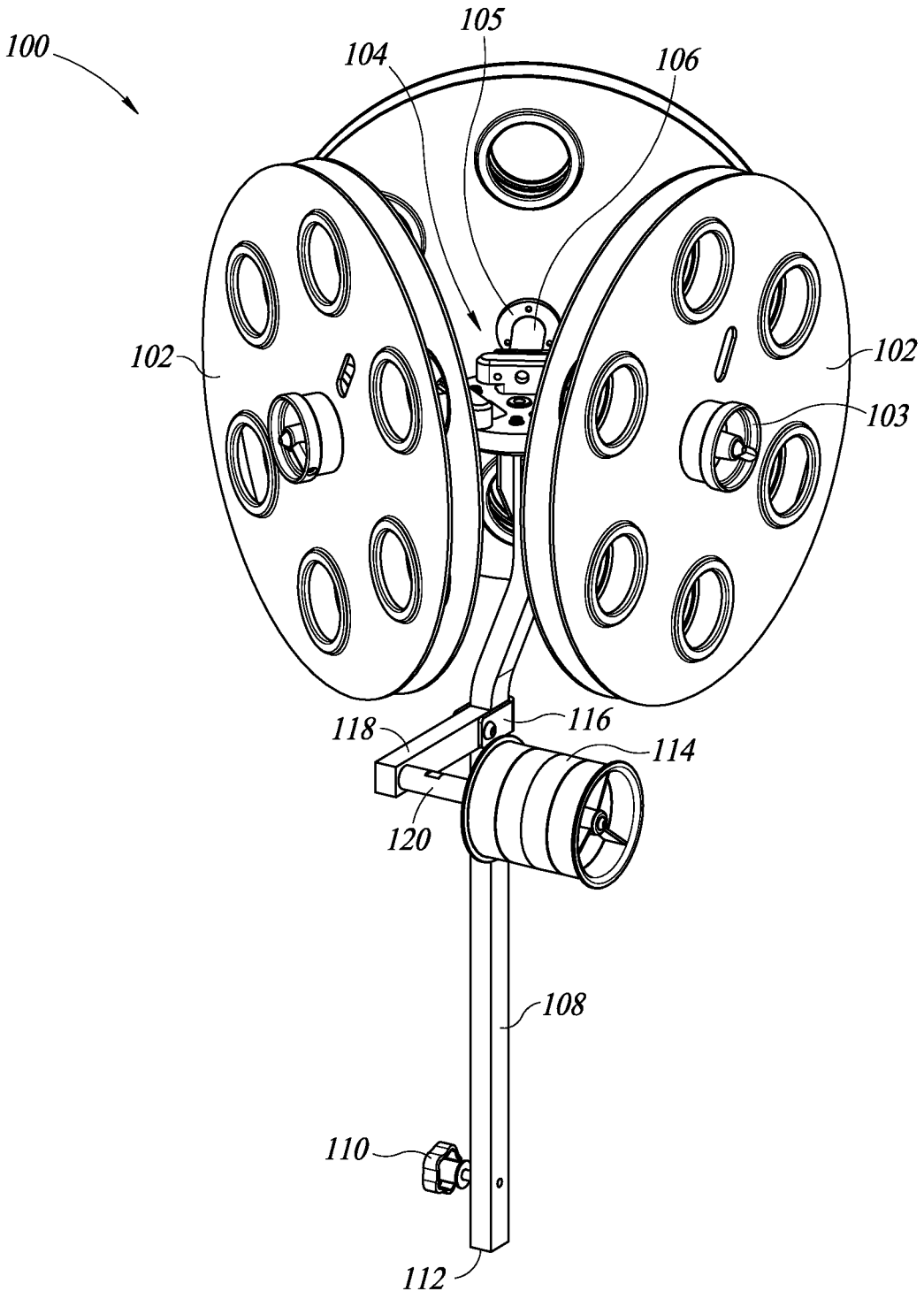
FIG. 1 is a perspective view of an embodiment of a reel assembly with a support device coupled to a plurality of reels according to the present disclosure.
Figure 2:
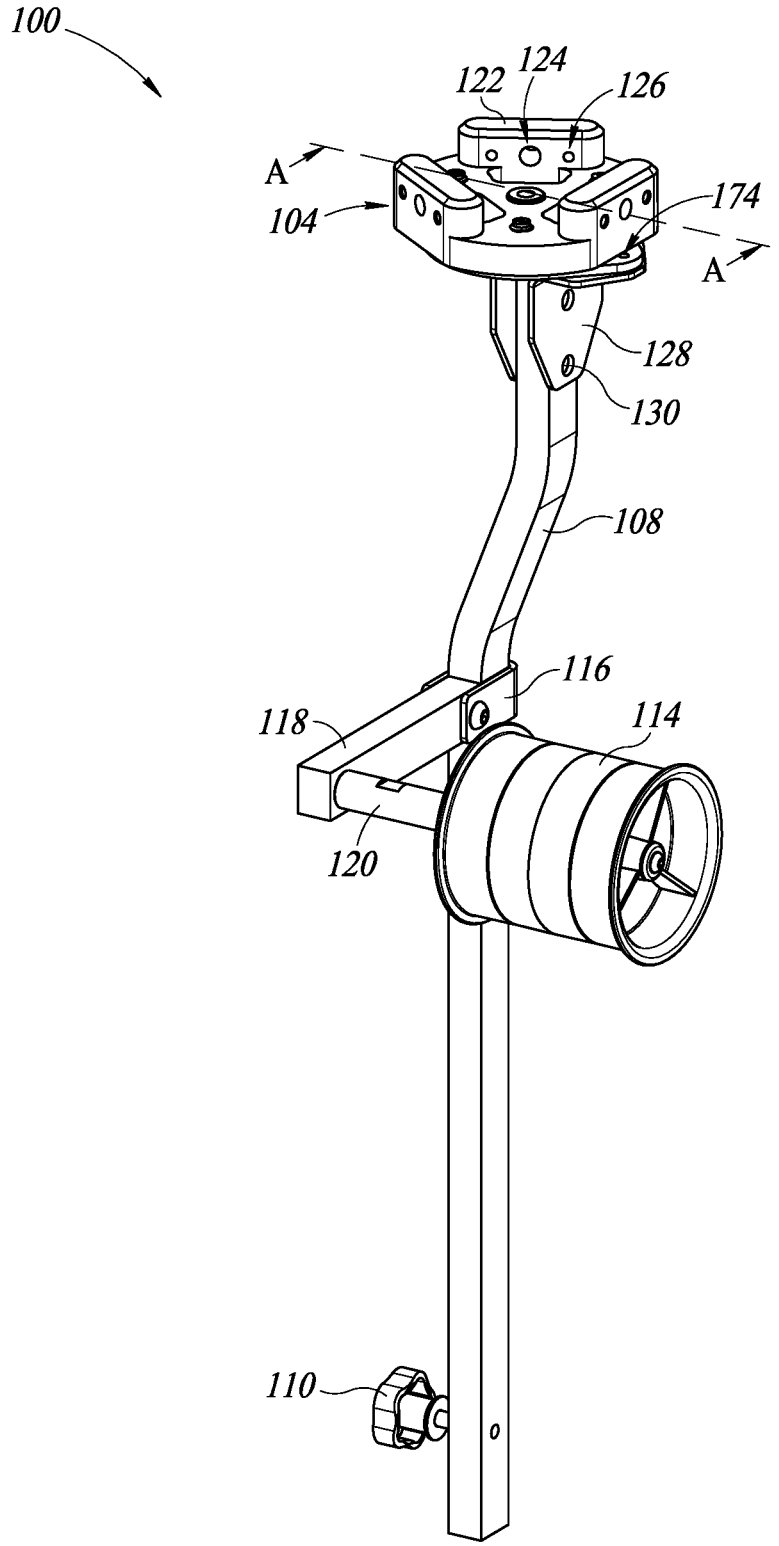
FIG. 2 is a perspective view of the reel assembly of FIG. 1 with the reels removed to better illustrate the support device in additional detail.

FIG. 1 and FIG. 2 illustrate a perspective view of one or more embodiments of a reel assembly 100. FIG. 1 illustrates the reel assembly 100 with a plurality of reels 102 coupled to a reel support device 104 (which may also be referred to herein as a turret 104) and FIG. 2 illustrates the reel assembly 100 without reels 102 in order to provide more detail regarding the reel support device 104.

With reference to FIG. 1 and FIG. 2, the reel assembly 100 includes the plurality of reels 102 coupled to the reel support device 104. More specifically, each of the reels 102 is coupled to the reel support device 104 by rods 106. The rods 106 may also be referred to herein as axles. There is an inner hub between the reels 102 and the rods 106 that spins while the reels 102 remain stationary, in some embodiments. The assembly 100 further includes reel fasteners 103 on the ends of the rods 106 outside of the reels 102 relative to the support device 104 as well as a stop plate or back plate 105 on the rods 106 inside of the reels 102 relative to the support device 104. The reel fasteners 103 and the stop plates 105 keep the reels 102 in position and aligned during rotation of the inner hub of the reels 102.

The material on the reels 102 can include labels, ties, closures, coupons, and other like materials. For example, in some embodiments, a first one of the reels 102 includes labels wound around the first reel 102 and a second one of the reels 102 includes plastic bag closures, which may also be referred to herein as locks, wound around the second reel 102. The third reel 102 may include labels or closures, or another different type of material. Example closures and labels that may be wound around reels 102 are manufactured by Kwik Lok® Corporation. In some embodiments, each of the reels 102 carries the same material, while in other embodiments, the reels 102 each carry different materials. As such, the operator can select the materials to be dispensed from each of the reels 102.

Further, in some embodiments, the reel assembly 100 is used with an automatic machine for applying the material on the reels 102 to a product or product packaging. The machine is configured to apply the materials from one side of the product packaging while the packaging passes along a conveyor, such as from a left side or a right side of the conveyor. The materials on the reels 102 may also be configured accordingly to be applied from the left or right side. For example, when the material on the reels 102 is a plurality of closures, the closures may have an opening on one side. As such, the closures are wound on the reels 102 such that the opening is facing the proper direction for application to the product as the materials are fed from the reels 102. As such, the operator may also be able to select the orientation of the materials to be fed from the reels 102.

The reel assembly 100 further includes a mast 108 coupled to the reel support device 104. The mast 108 is configured to be coupled to any number of external support structures, such as a manufacturing conveyor, a piece of manufacturing equipment, a support stand, a frame, or any other like structure in order to support the reel support device 104 and the reels 102 above a product packaging environment. In one or more embodiments, the reel support device 104 and the reels 102 are located vertically above a processing area via mast 108.

As shown in FIG. 1 and FIG. 2, the reel assembly 100 further includes a knob 110 that is used in securing the mast 108 to an external structure. For example, a bottom end 112 of the mast 108 may be inserted into a correspondingly shaped support structure or bracket. The knob 110 is inserted through a hole in the support structure and a corresponding hole in the mast 108. The operator then tightens the knob 110 to secure the mast 108 to the support structure with the mast in the vertical or substantially vertical (e.g., within 10 degrees of vertical) position shown. In some embodiments, each of the reels 102 is a reel assembly with an outer reel plate and an inner reel plate relative to the reel support device 104. When the operator wishes to change an empty reel 102 for a full reel 102, the operator removes the reel fastener 103 corresponding to the reel 102 that is to be changed. The reel fastener 103 is attached to the outer reel plate, such that removing the reel fastener 103 allows for removal of the outer reel plate to open up the reel 102 assembly. Once the outer reel plate is removed, a new roll of material can be loaded on the hub of the reel 102. Once the material inside the empty reel 102 is replaced, the operator replaces the outer reel plate and the reel fastener 103 that is attached to the outer reel plate 102 to secure the material inside the reel 102.

To assist with changing or replacing the material in the reels 102, the operator can also loosen the knob 110, which allows the reel support device 104 and reels 102 to rotate relative to the mast 108, in some embodiments. This is particularly helpful for the procedure for replacing the material in the reels 102 described above, because the operator can rotate the reels 102 into reach for convenient replacement of the material on the reels 102. When the reel support device 104 is tilted, the spring plungers 182 described herein provide tension to keep the reels in place, such that the reel assembly 100 does not rotate side to side via the reel support device 104.

The assembly 100 also includes a roller 114 coupled to the mast 108 below the reels 102. The roller 114 is coupled to the mast 108 by a bracket 116 coupled to the mast 108 and a link 118 that extends horizontal (or perpendicular to mast 108) as well as an axle 120 perpendicular to the link 118. The roller 114 has an axial bore that receives the axle 120, such that the roller 114 rotates about the axle 120. As materials are dispensed from the reel 102 above the roller 114, the materials pass over the roller 114, which rotates with the materials, and changes a direction of the string of materials so that they can be fed in a desired alignment into a track of a machine associated with the assembly 100. As such, the roller 114 prevents the materials on the reels 102 from snapping in the track of the machine, which reduces the likelihood of the materials breaking or jamming in the track.

With reference to FIG. 2, the reel support device 104 includes a plurality of flanges 122 extending from the reel support device 104. The rods 106 illustrated in FIG. 1 are coupled to the flanges 122 through first holes 124 in a center of each flange 122. In some embodiments, the rods 106 are received in the first holes 124, while in some embodiments, the rods 106 are coupled to the flanges 122 with a fastener, such as a bolt, inserted through first holes 124 and secured to the rod 106, such as by internal threads in ends of the rod 106. The flanges 122 further include second holes 126 that assist with securing rods 106 to the flanges 122. For example, in some embodiments, a bracket is coupled to the flanges 122 for receiving the rods 106, with the bracket secured to the flanges 122 via the first and second holes 124, 126. FIG. 2 further illustrates that the support device 104 is coupled to the mast 108 with brackets 128. The brackets 128 have an L-shape with holes 130 that align with holes through the mast 108 and the support device 104, such that fasteners can be received in the holes 130 to secure the support device 104 to the mast 108 via the brackets 128.

Figure 3:
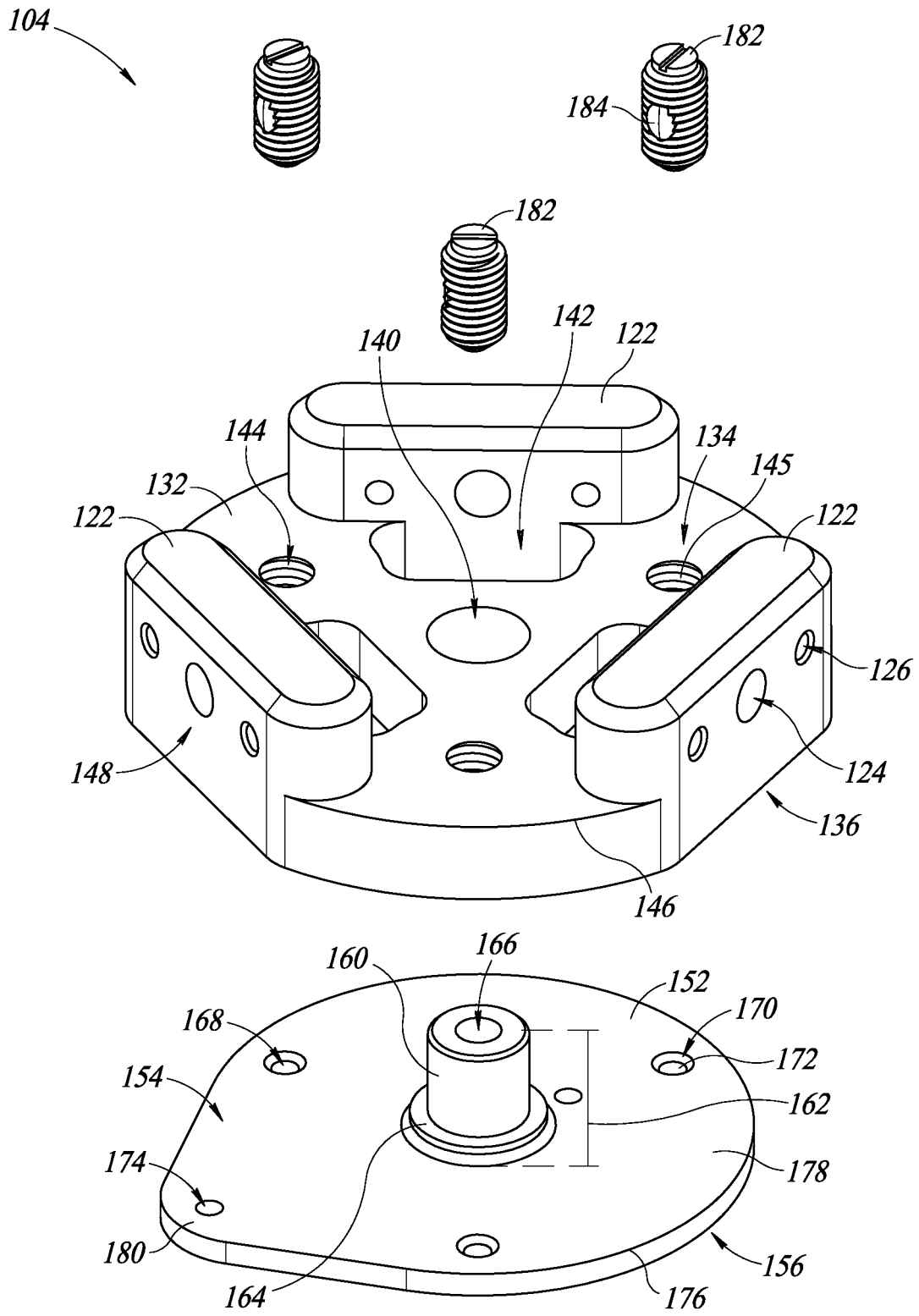
FIG. 3 is an exploded perspective view of the support device of FIG. 2.
Figure 4:
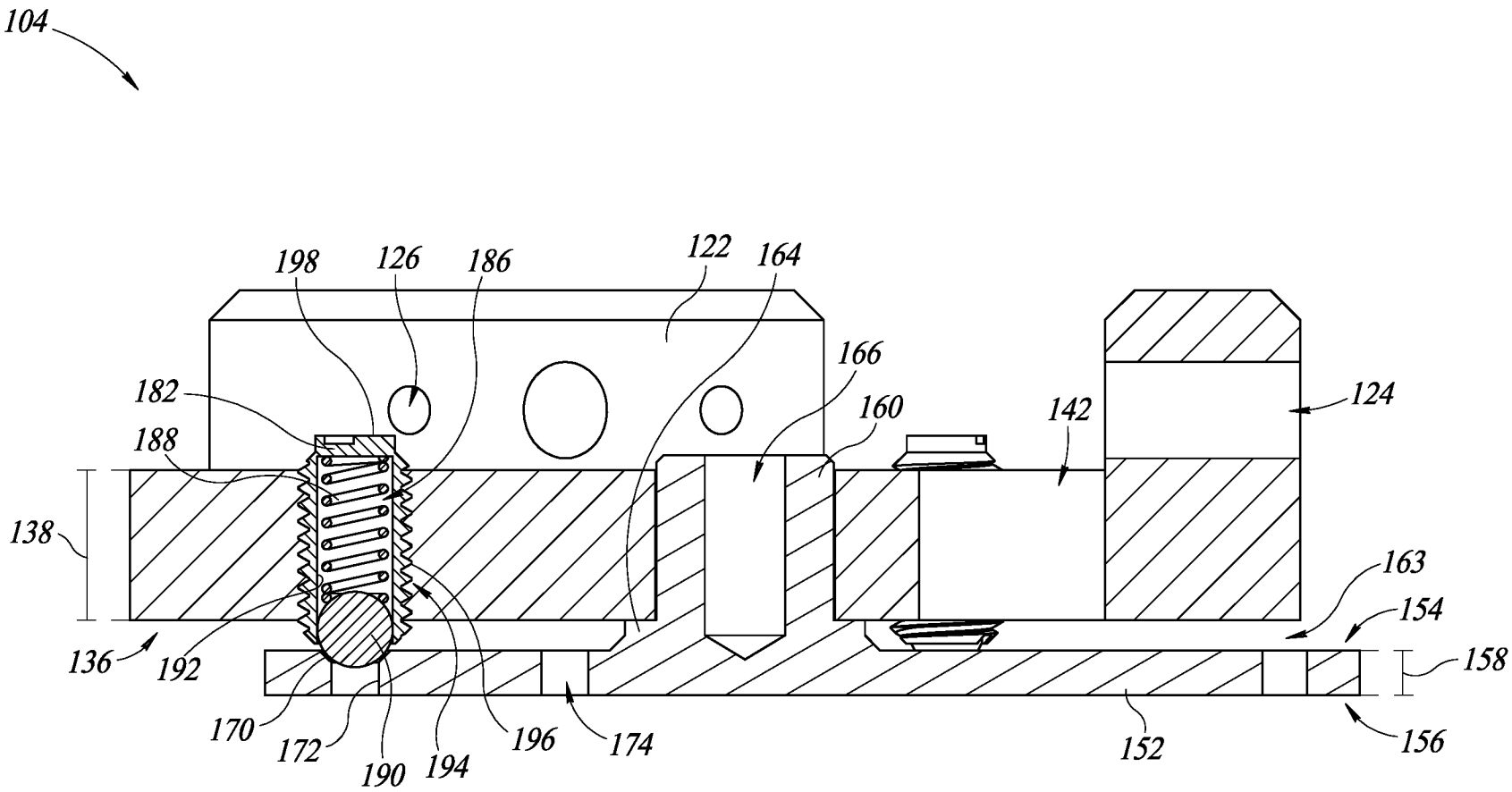
FIG. 4 is a cross-sectional view of the support device of FIG. 2 through line A-A in FIG. 2.

FIG. 3 is an exploded view of the reel support device 104 and FIG. 4 is a cross-sectional view of the assembled reel support device 104 through line A-A in FIG. 2. With reference to FIGS. 3 and 4, the reel support device 104 includes a first plate 132, which may also be referred to as a top plate, in some embodiments. The first plate 132 has a top surface 134 and a bottom surface 136 opposite the top surface 134 across a height 138 of the first plate 132. As shown more clearly in FIG. 4, the top surface 134 and the bottom surface 136 of the first plate 132 are flat and planar, in some embodiments. The first plate 132 further includes the plurality of flanges 122 extending from the top surface 134. As shown in FIG. 3, the support device 104 includes three flanges 122 in one or more embodiments. However, it is to be appreciated that the support device 104 can include more or fewer than three flanges 122, such as two flanges or three, four, five, or more flanges. Each flange 122 includes the first hole 124 and second holes 126 described above with reference to FIG. 2.

In the illustrated embodiment, the flanges 122 extend from the top surface 134 perpendicular to the top surface 134, such that the flanges 122 are vertical relative to the top surface 134, in some embodiments. In one or more embodiments, the flanges 122 are at an angle to the top surface 134 that is not equal to 0 degrees and not equal to 90 degrees. The first plate 132 further includes an axial bore 140 extending through the first plate 132 from the top surface 134 to the bottom surface 136. The axial bore 140 is circular in shape and extends vertically through a center of the top surface 134 and the bottom surface 136 with smooth sidewalls, in some embodiments. In one or more embodiments, the axial bore 140 is offset from a center of the top and bottom surfaces 134, 136 and may include threads or other protrusions.

The first plate 132 further includes a plurality of apertures 142 extending through the first plate 132. The plurality of apertures 142 have a trapezoidal shape and are spaced equidistant about the axial bore 140, in one or more embodiments. Further, the first plate 132 may include three apertures 142, with one aperture 142 extending through the first plate 132 adjacent each of the plurality of flanges 122 and spaced from the axial bore 140. As such, some embodiments include one aperture 142 per flange 122. However, in some embodiments, there are more or fewer than three apertures, such as no apertures, one aperture, two apertures, or four, five, six, or more apertures 142. Further, the apertures 142 may be spaced from the flanges 122, such that the apertures 142 are proximate the flanges 122, but not adjacent to the flanges 122. In one or more embodiments, the support device 104 does not include any apertures 142.

A plurality of third holes 144 extend through the first plate 132 and include threads 145 extending from sidewalls defining the third holes 144. As such, the third holes 144 may also be referred to as threaded holes. The third holes 144 are positioned between the apertures 142 and the flanges 122 and spaced equidistant from each other, in some embodiments. As illustrated in FIG. 3, there is one third hole 144 between successive ones of the flanges 122 and spaced equidistant between successive ones of the flanges 122. The positioning of the third holes 144 provides balance to the top plate 132 in the reel assembly 100. As will be explained in greater detail below, the first plate 132 is configured to rotate, in part via third holes 144, such that the third holes 144 are preferably spaced equidistant relative to each to ensure balanced rotation. However, the third holes 144 may be positioned anywhere on top surface 134 in various embodiments. Further, the third holes 144 may have smooth sidewalls in one or more embodiments instead of threads 145 along sidewalls of the third holes 144.

The first plate 132 further includes an outer peripheral edge 146 that bounds the top surface 134. The outer peripheral edge 146 is curved or rounded between the flanges 122, in some embodiments. The flanges 122 intersect the outer peripheral edge 146 and each include a flat and planar outer surface 148 to facilitate attachment of the reels 102 and rods 106 to the flanges 122. However, it is to be appreciated that the first plate 132 and outer peripheral edge 146, as well as the flanges 122 and outer surface 148 may be flat and planar, curved, linear, rectilinear, or any other shape.

FIG. 3 and FIG. 4 further illustrate a second plate 152 that is configured to be coupled to the first plate 132. The second plate 152 includes a top surface 154 and a bottom surface 156 opposite the top surface across a height 158 of the second plate 152. As shown in FIG. 4, each of the top and bottom surfaces 154, 156 are flat and planar in some embodiments. The second plate 152 further includes a protrusion 160 extending perpendicularly from the top surface 154. The protrusion 160 preferably has a size and a shape to be received within the axial bore 140 of the top plate 132. As such, in the illustrated embodiment, the protrusion 160 has a circular or cylindrical shape with a height 162 that corresponds to the height 138 of the first plate 132. In some embodiments, the height 162 of the protrusion 160 is greater than the height of the first plate 138, such that the protrusion 160 extends beyond the top surface 134 of the top plate 132 when the protrusion 160 is received in the axial bore 140 (see FIG. 4). In one or more embodiments, the protrusion 160 and the axial bore 140 are switched between the plates 132, 152, such that the first plate 132 has the protrusion 160 and the second plate 152 has the axial bore 140. Further, in some embodiments, any of the features of the first plate 132 and the second plate 152 described herein may be switched between the plates 132, 152. For example, the second plate 152 may have flanges 122, instead of first plate 132. As such, the present disclosure is not limited to the specific arrangement exemplified in the illustrated embodiments.

The second plate 152 also includes a bushing or ledge 164 extending from the top surface 154 around the protrusion 160. The ledge 164 provides a support surface for rotation of the first plate 132 relative to the second plate 152. In other words, the first plate 132 rests on the ledge 164, such that there is clearance between the bottom surface 136 of the first plate 132 and the top surface 154 of the second plate 152 for rotation of the first plate 132 relative to the second plate 152. Further, an axial bore 166 extends into the protrusion 160, but not all the way through the second plate 152, in some embodiments. In one or more embodiments, the axial bore 166 extends through the second plate 152. The axial bore 166 of the second plate 152 aligns with the axial bore 140 of the first plate 132, such that a fastener can be received in the bores 140, 166 to secure the first plate 132 to the second plate 152. As such, each of the bores 140, 166 may include threads along sidewalls defining the bores 140, 166, such as to receive a screw or bolt, or may have smooth sidewalls to receive other types of fasteners.

The second plate 152 further includes a plurality of fourth holes 168 extending through the second plate 152 from the top surface 154 to the bottom surface 156 of the second plate 152. The plurality of fourth holes 168 are aligned with the plurality of third holes 144 in the first plate 132 in order to function as detents. Moreover, the plurality of fourth holes 168 are configured to facilitate rotation of the first plate 132 relative to the second plate 152. For example, in one or more embodiments, the plurality of fourth holes 168 have a chamfered upper surface 170. In other words, a top edge defining the plurality of fourth holes 168 is chamfered to create the surface 170 at a transverse angle to sidewalls 172 defining the fourth holes 168. As shown in FIG. 3, there are three fourth holes 168 spaced equidistant about the protrusion 160 and corresponding to locations of the third holes 144, with each of the third holes 144 being equidistant from each other and each of the fourth holes 168 being equidistant from each other. In some embodiments, the chamfered surface 170 and the sidewalls 172 are smooth and do not include protrusions or threads, while in some embodiments, the sidewalls 172 include threads and the chamfered surface 170 may include one or more protrusions. The second plate 152 further includes a plurality of fifth holes 174 extending through the second plate 152 from the top surface 154 to the bottom surface 156. The plurality of fifth holes 174 are positioned to receive fasteners to secure the second plate 152 to brackets 128 to couple the second plate 152 to mast 108 (see FIG. 2).

The second plate 152 includes an outer peripheral edge 176 bounding the top surface 154. Further, the second plate 152 includes a first portion 178 integral with a second portion 180 as a single component. The first portion 178 is a rounded or circular region of the second plate 152 that includes the plurality of fourth holes 168 and one of the plurality of fifth holes 174, in some embodiments. As such, in the first portion, the outer peripheral edge 176 is generally circular. The second portion 180 is a rounded extension or rounded point to provide additional surface area for one of the plurality of fifth holes 174. The configuration of the first and second portions 178, 180 enables placement of the fifth holes 174 in the second plate 152 to facilitate the coupling to brackets 128 without interfering with rotation of the first plate 132 relative to second plate 152 while also ensuring that there is enough material of the second plate 152 between the protrusion 160, fourth holes 168, and fifth holes 174 to maintain structural integrity of the second plate 152 and the reel support device 104. As such, the second plate 152 has a different size and shape than the first plate 132 to provide support for the connections discussed herein. The reel support device 104 further includes a plurality of fasteners 182 that will be described in additional detail with reference to FIG. 4. The plurality of fasteners 182 may also be referred to as spring plungers, in one or more embodiments.

In some embodiments, the fasteners 182 each include a thread collar 184 in a portion of a side of the fastener 184. The thread collar 184 secures the fasteners to the threads 145 of the third holes 144 by deforming as the fasteners 182 are secured in the third holes 144 via threads 145. As such, the thread collar 184 may also be referred to as a thread lock. In some embodiments, the fasteners 182 do not include thread collars 184. Further, in one or more embodiments, a thread locking material is applied to an entirety of the threaded portion of the fastener 182 instead of the thread collar 184. In other words, in some embodiments, the fasteners 182 do not include the thread collar 184, but rather, include an additional layer of material on the threads of the fasteners 182 to secure the fasteners in third holes 144.

FIG. 4 illustrates the reel support device 104 with the first plate 132 coupled to the second plate 152 with the protrusion 160 received in and extending through the axial bore 140 of the first plate 132. As shown in FIG. 4, the first plate 132 is coupled to the second plate 152 with the bottom surface 136 of the first plate 132 facing the top surface 154 of the second plate 152. FIG. 4 further illustrates the fasteners 182 inserted through each of the third holes 144 with a portion of the fastener received in the fourth holes 168. The fasteners 182 each include a hollow internal cavity 186 with an elastic element 188, such as a spring or other like object, positioned in the hollow internal cavity.

The fasteners 182 further include a ball 190 positioned at a lower end of the fastener 182 and extending from the bottom of the fasteners 182. In other words, a portion of the ball 190 of each fastener 182 is exposed at the bottom of each fastener 182. The ball 190 is held in position by sidewalls 192 of the fasteners 182, with the elastic element 188 acting on the ball 190. The fasteners 182 include a first portion 194 with threads 196 extending from the sidewalls 192 of the fasteners 182. As such, the first portion 194 is a threaded portion of the fasteners 182, in some embodiments. The fasteners 182 further include a second or fastening portion including the ball 190. In some embodiments, the fasteners 182 include a standard fastener head 198 with an insert for a screwdriver or drill bit.

The fasteners 182 are coupled to the reel support device 104 by rotating the first or threaded portion 194 of the fasteners 182 into the threads 145 of the third holes 144. As shown in FIG. 4, the ball 190 and a portion of the threads 196 extend beyond the bottom surface 136 of the first plate 132. The ball 190 of each fastener 182 is received in a corresponding fourth hole 168. More specifically, the ball 190 is positioned adjacent the chamfered surface 170 or in direct contact with the chamfered surface 170, in some embodiments. However, a diameter of ball 190 is greater than a width of the fourth holes 168, such that the ball 190 is not received in the fourth holes 168. The elastic element 188 holds the ball 190 in position in the fourth holes 168 proximate chamfered surface 170. The force to depress the ball 190 into the internal cavity 186 (e.g., the force to bias elastic element 188) can be selected and is not limited to any specific range, but in some embodiments, the force to depress the ball 190 is between 18 and 25 pounds, or more or less. In some embodiments, the fasteners 182 are steel metric ball-nose spring plungers manufactured by McMaster-Carr®. While the size of the spring plunger can be selected, the fasteners 182 are M12x1.75 thread with 16.8-25.7 pound nose force, in some embodiments.

As such, in operation, the first plate 132 is secured to the second plate 152 with the protrusion 160 of the second plate 152 received in the axial bore 140 of the first plate 132. A portion of the bottom surface 136 of the first plate 132 rests on the ledge 164 extending from the first surface 154 of the second plate 152 around the protrusion 160. As such, there is a space or gap 163 between the bottom surface 136 of the first plate 132 and the top surface 154 of the second plate 152. The space 163 provides clearance for rotation of first plate 132 relative to second plate 152 and also reduces the contact surface area between the first and second plates 132, 152, which reduces friction during rotation. In some embodiments, the ledge 164 is a bearing to further facilitate rotation and reduce friction. A fastener, such as a screw or bolt, is inserted into axial bore 166 of the protrusion 160 to couple the first plate 132 to the second plate 152.

Fasteners 182 are inserted through third holes 144 with threads 196 of the fasteners 182 coupled to corresponding threads 145 of third holes 144. The ball 190 of each fastener 182 extends beyond the bottom surface 136 of the first plate 132 and is received in a corresponding fourth hole 168 on chamfered surface 170. Reels 102 are coupled to flanges 122 of the first plate 132 through rods 106 (see FIG. 1 and FIG. 2). When an operator wishes to rotate the first plate 132 to change the reel 102 that is in position for production (see FIG. 1), the user provides a lateral force (e.g., a left or right force) on the first plate 132, which compresses the elastic elements 188 in the fasteners 182 and allows the ball 190 of each fastener 182 to release from a corresponding fourth hole 168. Once the balls 190 of the fasteners 182 are released from the fourth holes 168, the user rotates the top plate 132 a ⅓ turn or 120 degrees (or any other amount of rotation corresponding to the number of third and fourth holes 144, 168), until the balls 190 are received in a successive one of the fourth holes 168. In embodiments that include the chamfered surface 170, the surface 170 assists with moving the ball 190 into and out of the fourth holes 168.

It is to be appreciated that an angle and depth of chamfered surface 170 can be selected to change the force to move the first plate 132 relative to second plate 152. For example, a shallower surface 170 with a smaller angle relative to horizontal than the one shown will result in the ball 190 moving out of the fourth hole 168 with less force than where the chamfered surface 170 is deeper and has a greater angle relative to horizontal. Moreover, the elastic force of the elastic element 188 of each fastener 182 can be selected, with each fastener 182 having the same or different elastic forces, in order to vary the force to move the ball 190 in and out of each fourth hole 168. Further, the number of fasteners 182 and corresponding third and fourth holes 144, 168 can be selected according to the desired force for moving first plate 132 relative to second plate 152. More fasteners 182 and holes 144, 168 results in more force to move the first plate 132 and vice versa. As such, while the embodiments of the disclosure provide a balanced arrangement where the fasteners 182 provide enough elastic force for the first plate 132 to be secured in position during normal operation of reel assembly 100 while maintaining ease of use and rotation for operators, other forces can be selected to change the application of the reel support device 104. As such, the present disclosure is not limited to the examples provided herein.

In view of the above, the reel support device 104 and reel assembly 100 described herein increase capacity over known systems and devices by adding at least one additional reel of material. Not only does this allow users to increase output using less machines, but less staff may be needed to keep closure machines stocked because material changes are less frequent. Further, the reel support device 104 is easier to manipulate or rotate by an operator, which increases efficiency and reduces downtime. The reel support device 104 also includes less components (e.g. is less complicated) than known devices, which decreases maintenance and reduces downtime for repairs and replacement of components. Moreover, the reel support device allows for use of at least three reels, which increases applicability because operators can select reels of different materials for production runs while also reducing downtime associated with switching reels.

In the above description, certain specific details are set forth in order to provide a thorough understanding of various disclosed embodiments. However, one skilled in the relevant art will recognize that embodiments may be practiced without one or more of these specific details, or with other methods, components, materials, etc. In other instances, well-known structures associated with reel assemblies and reel support devices or "turrets" have not been shown or described in detail to avoid unnecessarily obscuring descriptions of the embodiments.

Unless the context requires otherwise, throughout the specification and claims which follow, the word "comprise" and variations thereof, such as, "comprises" and "comprising" are to be construed in an open, inclusive sense, that is as "including, but not limited to." Further, the terms "first," "second," and similar indicators of sequence are to be construed as interchangeable unless the context clearly dictates otherwise.

Reference throughout this specification to "one embodiment" or "an embodiment" means that a particular feature, structure or characteristic described in connection with the embodiment is included in at least one embodiment. Thus, the appearances of the phrases "in one embodiment" or "in an embodiment" in various places throughout this specification are not necessarily all referring to the same embodiment. Furthermore, the particular features, structures, or characteristics may be combined in any suitable manner in one or more embodiments.

As used in this specification and the appended claims, the singular forms "a," "an," and "the" include plural referents unless the content clearly dictates otherwise. It should also be noted that the term "or" is generally employed in its broadest sense, that is as meaning "and/or" unless the content clearly dictates otherwise.

The relative terms "approximately" and "substantially," when used to describe a value, amount, quantity, or dimension, generally refer to a value, amount, quantity, or dimension that is within plus or minus 5% of the stated value, amount, quantity, or dimension, unless the content clearly dictates otherwise. It is to be further understood that any specific dimensions of components provided herein are for illustrative purposes only with reference to the exemplary embodiments described herein, and as such, the present disclosure includes amounts that are more or less than the dimensions stated, unless the context clearly dictates otherwise. Further, unless the context clearly dictates otherwise, all of the components described herein can be comprised of metal, such as steel, stainless steel, aluminum, and other like materials.

The above description of illustrated embodiments, including what is described in the Abstract, is not intended to be exhaustive or to limit the embodiments to the precise forms disclosed. Although specific embodiments of and examples are described herein for illustrative purposes, various equivalent modifications can be made without departing from the spirit and scope of the disclosure, as will be recognized by those skilled in the relevant art. The teachings provided herein of the various embodiments can be applied outside of the product packaging and reel assembly context, and not necessarily the reel assembly systems, methods, and devices generally described above.

The various embodiments described above can be combined to provide further embodiments. To the extent that they are not inconsistent with the specific teachings and definitions herein, all of the U.S. patents, U.S. patent application publications, U.S. patent applications, foreign patents, foreign patent applications and non-patent publications referred to in this specification and/or listed in the Application Data Sheet are incorporated herein by reference, in their entirety. Aspects of the embodiments can be modified, if necessary to employ concepts of the various patents, applications and publications to provide yet further embodiments.

These and other changes can be made to the embodiments in light of the above-detailed description. In general, in the following claims, the terms used should not be construed to limit the claims to the specific embodiments disclosed in the specification and the claims, but should be construed to include all possible embodiments along with the full scope of equivalents to which such claims are entitled. Accordingly, the claims are not limited by the disclosure.

The invention claimed is:

1. A system, comprising:

a reel support device, including:

a first plate;

a second plate coupled to the first plate;

a plurality of cavities in the second plate;

a plurality of springs, each of the springs having a ball received in a corresponding one of the plurality of cavities of the second plate, wherein the first plate is configured to rotate relative to the second plate.

2. The system of claim 1 further comprising:

a mast coupled to the reel support device, wherein the reel support device is configured to rotate relative to the mast.

3. The system of claim 2 wherein the first plate includes a plurality of flanges, the system further comprising:

a plurality of reels coupled to the plurality of flanges of the first plate; and a payoff reel coupled to the mast and aligned with one of the plurality of reels.

4. The system of claim 3 wherein each of the plurality of reels includes a plurality of closures, a plurality of labels, or both, wound around the reel.

5. The system of claim 3 wherein a first one of the plurality of reels includes a plurality of closures and a second one of the plurality of reels includes a plurality of labels.

6. The system of claim 1 wherein the plurality of cavities in the second plate include a first surface and a second surface transverse to the first surface, the ball of each of the springs received in the corresponding one of the plurality of cavities in contact with the second surface.

7. The system of claim 1 wherein the first plate is configured to rotate relative to the first plate manually by applying a force to the first plate to unseat each of the balls of the plurality of springs from the plurality of cavities.

8. A device, comprising:

a first plate having a plurality of flanges each configured to be attached to a reel;

a second plate coupled to the first plate, the first plate configured to rotate relative to the first plate;

a plurality of first holes through the first plate;

a plurality of second holes through the second plate, each of the plurality of second holes having a chamfered edge; and a plurality of first fasteners, each including a ball and each extending through a corresponding one of the plurality of first holes with the ball received in a corresponding one of the plurality of second holes.

9. The device of claim 8 wherein the first plate includes a first surface and a second surface opposite the first surface, the plurality of flanges extending from the first surface and spaced equidistant from each other.

10. The device of claim 9 wherein the first surface of the first plate includes an outer edge, the outer edge including a plurality of curved portions and a plurality of rectilinear portions, the plurality of flanges disposed at the rectilinear portions.

11. The device of claim 8 wherein the plurality of first holes are spaced equidistant from each other with one first hole between successive ones of the plurality of flanges.

12. The device of claim 8 wherein the first plate includes a first bore and the second plate includes a protrusion with a size and a shape to be received in the first bore of the first plate, the first plate configured to rotate about the protrusion of the second plate.

13. The device of claim 12 wherein the protrusion of the second plate includes a second bore aligned with the first bore, the first bore and the second bore configured to receive a second fastener to couple the first plate to the second plate.

* * * * *